United States Patent [19]

Wankel et al.

[11] Patent Number: 4,907,716

[45] Date of Patent: Mar. 13, 1990

[54] LOCK MECHANISM

[76] Inventors: Dean R. Wankel; Patricia S. Wankel, both of Rolling Acres #155, Jacksonville, Ill. 62650

[21] Appl. No.: 379,101

[22] Filed: Jul. 13, 1989

[51] Int. Cl.[4] ..... B65D 55/14

[52] U.S. Cl. ..... 220/326; 70/169; 70/346; 70/360

[58] Field of Search ..... 70/360, 346, 345, 169, 70/449, DIG. 34, DIG. 79; 24/596; 292/62; 220/324, 326

[56] References Cited

U.S. PATENT DOCUMENTS

| | | | |
|---|---|---|---|
| 47,537 | 5/1865 | Ford | 292/62 |
| 1,956,029 | 4/1934 | Holmes | 24/596 |
| 3,102,411 | 9/1963 | Friedman | 292/62 X |
| 3,578,156 | 5/1971 | Norby | 220/324 X |
| 3,930,388 | 1/1976 | Barras | 70/159 |
| 4,442,571 | 4/1984 | Davis et al. | 24/596 X |
| 4,551,999 | 11/1985 | Guiler | 70/159 |

FOREIGN PATENT DOCUMENTS

| | | | |
|---|---|---|---|
| 612846 | 5/1935 | Fed. Rep. of Germany | 70/345 |
| 341849 | 7/1936 | Italy | 220/326 |
| 173639 | 1/1922 | United Kingdom | 70/345 |

*Primary Examiner*—Lloyd A. Gall

[57] ABSTRACT

A key-operated lock installable on a portable cooler cabinet and associated lid, with the lock surfaces substantially flush with the cabinet-lid surfaces. The lock includes a lock bolt housing formed by two telescopically connected tubes extendable through aligned openings in two spaced walls of the cabinet lid. The key-operated bolt is movable axially and rotationally to effect a lock action.

4 Claims, 1 Drawing Sheet

LOCK MECHANISM

BACKGROUND AND SUMMARY OF THE INVENTION

Portable cooler cabinets are in general use for containment of soft drinks, beer, cream and other edibles that need to be kept at low temperatures. Ice or solid $CO_2$ is deposited into the cooler to provide the necessary cooling effect.

These portable coolers are usually rectangular box-like structures having minimum dimensions on the order of one foot high, two feet long, and one foot wide. The box structures are open at the top to receive a lid. The lid may be completely removable from the box or connected to the box via hinges. In either event the lid fits rather tightly against the upper rim surface of the box in order to form a seal that prevents such air circulation into or out of the box as might lead to premature loss of cooling effect of the ice within the box.

Commonly these cooler cabinets are double walled structures, i.e. structures wherein the bottom and sides are each formed of two spaced apart plastic walls; the wall spacing may be on the order of one inch, which is sufficient to form a significant thermal barrier between the space inside the cooler cabinet and the space outside the cooler cabinet. The lids for the cooler cabinets are also of double walled construction, such that the cabinet and lid cooperatively form a complete thermal barrier around the soft drinks, etc. contained within the cabinet.

It would be desirable to equip these cooler cabinets with key-operated locks. However the double-walled nature of the cooler construction makes it difficult to mount conventional lock devices on the cabinet and lid surfaces. Part of the problem is the fact that the lid lower surface must seat flush against the upwardly facing rim surface of the cabinet in order to maintain an air seal around the cabinet perimeter. The lock components cannot protrude any appreciable distances from the lid surface or cabinet surface; otherwise the air seal will be lost.

My invention relates to a relatively low cost lock assembly that can be mounted on the lids and cabinets of conventional double-walled coolers. The lock components are designed to be substantially flush with the exposed cabinet-lid surfaces, so that the locking action is achieved without adversely affecting the necessary cooling action taking place within the cabinet.

THE DRAWINGS

DESCRIPTION OF A PREFERRED EMBODIMENT OF THE INVENTION

Figure 1:
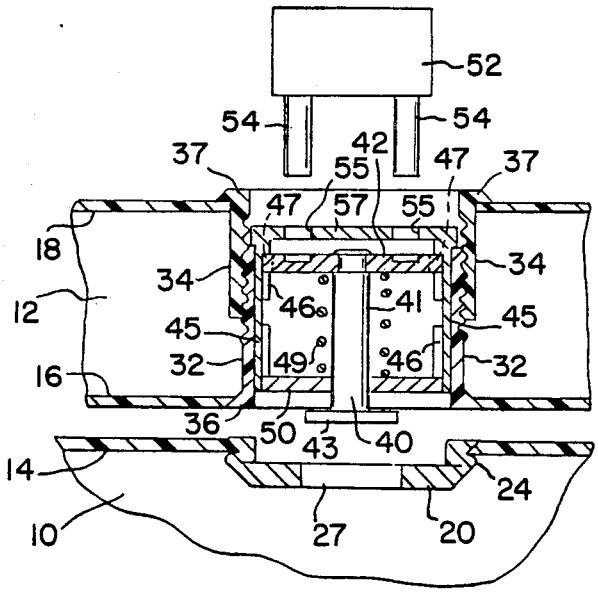
FIG. 1 is a fragmentary sectional view of a locking mechanism of the present invention, shown installed on a conventional portable cooler cabinet and associated lid.
Figure 2:
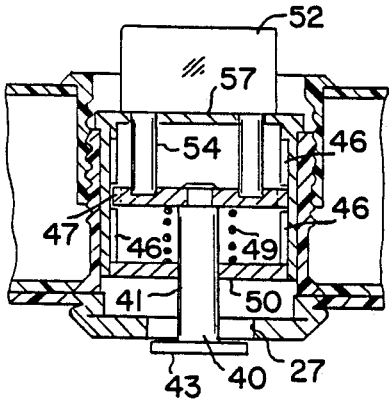
FIG. 2 is a view similar to FIG. 1, but with the lock components in a different position of adjustment.
Figure 3:
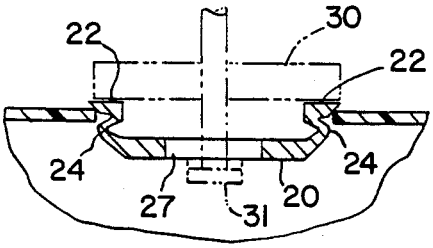
FIG. 3 shows a structural detail of the FIG. 1 mechanism, but taken prior to final installation on the associated cabinet structure.

The drawings fragmentarily show a cooler cabinet 10 and associated lid 12. As seen in FIG. 1, the lid is spaced a slight distance above the cabinet; in FIG. 1 numeral 14 references an upwardly facing rim wall of the cabinet, whereas numerals 16 and 18 reference the spaced walls of the overlying lid. The lower exposed face of lid structure wall 16 is designed to substantially seat against the upper exposed face of cabinet wall 14 to form an air seal, as shown in FIG. 2. Some slight spacing between walls 14 and 16 can be tolerated.

My invention concerns a lock mechanism installed in cabinet lid 12 and cabinet 10 so that the registering lock surfaces are substantially flush with the exposed faces of walls 14 and 16. In my proposed lock mechanism the keeper mechanism is installed on cabinet wall 14, whereas the lock bolt mechanism is installed on lid 12 in the space between lid walls 16 and 18. Holes must be drilled in the various walls to effect an operative installation.

The keeper mechanism comprises a metal plate 20 connected to an annular seat element 22 via a thin annular web 24. Element 22 preferably has an outer beveled edge adapted to seat against the edge of a circular hole formed in cabinet wall 14. A slot opening 27 is formed in plate 20.

The keeper mechanism may be affixed to cabinet wall 14 by applying an axial squeezing force to the lower face of plate 20 and the upper face of annular element 22. For example, a bolt may have its head 31 inserted through slot 27 to hold a transverse strap against the concealed undersurface of plate 20; at the same time a nut 30 may be threaded onto the bolt so that a squeezing force is applied to elements 20 and 22. FIG. 1 shows the keeper mechanism in the installed flush condition, wherein the edge of the hole in the wall 14 is gripped by the deformed web 24. Web 24 buckles in the fashion of a conventional toggle bolt.

The lock bolt mechanism comprises a tubular housing formed by two telescopically-connected tubes 32 and 34. Each tube is preferably a plastic tube having a series of circumferential ridges and interspersed grooves thereon. As shown, the ridges and grooves for tube 32 are formed on the outer surface of the tube, whereas the ridges and grooves for tube 34 are formed on the inner surface of that tube. The tubes are extended from opposite sides of the lid structure through circular openings in lid walls 16 and 18. As the tubes telescope together the ridges deform slightly so as to pass over one another. Flanges 36 and 37 on the outer ends of the tubes clamp against the exposed faces of lid walls 16 and 18. Flange 36 has a beveled cross-section, such that it is substantially flush with the exposed face of wall 16. Walls 16 and 18 are usually semi-resilient and deformable, such that axial pressure on the tubes will enable the tube ridges to snap into the associated grooves, while achieving a tight fit of the tubular housing against walls 16 and 18. Slight deformation of wall 16 by flange 36 will promote a flush relationship between the flange and wall 16 surface.

A lock bolt 40 is arranged for axial and rotary motion within the tubular housing. The lock bolt comprises an axial shaft 41 having a key-engageable plate 42 at one end and a transverse hook (bar) 43 at its other end. Bolt 40 is supported within the tubular housing by an annular guide means that can include a tubular wall 45 having two diagrammatically spaced slots 46 extending therealong. The associated plate 42 will have fingers 47 extending into slots 46, such that bolt 40 is normally prevented from rotation around the shaft 41 axis. A coil type compression spring 49 is trained between plate 42 and a second shaft guide plate 50 suitably affixed to tubular wall 45.

The lock bolt 40 is moved from the FIG. 1 position to the FIG. 2 position by means of a manual key 52. The key may have two pins 54 extendable through arcuate slots 55 in a fixed plate 57. The ends of the pins enter into depressions in the face of plate 42.

When key 52 is fully depressed (as in FIG. 2) plate 42 will be at a predetermined position of axial adjustment wherein slots 46 are interrupted (as in FIG. 2). At that point, the key can be turned to rotate the locking bolt around the axis of shaft 41; slots 55 are arcuate so as to permit the key to rotate. Hook 43 is oriented on shaft 41 so that when the key is turned the hook will have passed through slot opening 27, such that it will be in position to lockably engage the concealed face of keeper plate 20. The key motion can be reversed to enable spring 49 to move bolt 40 to the unlocked condition.

The illustrated lock construction is a relatively inexpensive structure designed for installation on a conventional portable cooler cabinet (and associated lid) having the spaced wall type construction. The keeper and lock bolt housing are adapted to be flush or substantially flush with the associated walls 14 and 16 of the cabinet. Installation of the lock mechanism requires the drilling of three holes; two holes in the lid, and a third hole in cabinet wall 14. The holes should be in reasonably accurate axial alignment, but extreme precision is not necessary. The telescopic connection between housing tubes 32 and 34 is adjustable to fit a range of different spacings between lid walls 16 and 18; thus, whatever the spacing between walls 16 and 18, the tubes can be telescoped together to obtain a suitable fit between the tubular housing and the lid structure walls.

The drawings show one form that the invention can take. Other forms are possible.

I claim:

1. In association with a cooler cabinet that includes a wall having one exposed face and one concealed face; and a lid that includes two spaced walls, each of which has one exposed face and one concealed face, the improvement comprising:

a lock bolt mechanism secured to the lid, and a keeper mechanism secured to the cabinet;

said keeper mechanism comprising a plate affixed to said cabinet wall so that it does not project beyond the exposed face of the wall;

said plate having a slot therethrough;

said lock bolt mechanism comprising a tubular housing that includes two telescopically connected tubes extending into the space between the lid walls; said tubes having external flanges thereon exerting clamp forces on the exposed faces of the lid walls so that the tubular housing extends entirely through the lid; a lock bolt arranged for axial and rotary motion within the tubular housing; guide means within the housing constraining the bolt against rotary motion except when said bolt is in a predetermined position of axial adjustment;

a hook carried on the bolt in registry with the slot in the keeper plate;

spring means biasing the lock bolt away from the keeper plate; and a manually-operated key engageable with the bolt to move same axially a predetermined distance to the aforementioned predetermined position, after which the key can be rotated to turn the bolt and associated hook;

said hook being oriented on said bolt so that when the key is turned the hook will lockably engage a concealed face of the keeper plate.

2. The improvement of claim 1 wherein said tubular housing has one end thereof in registry with said keeper mechanism, said one end of the tubular housing being substantially flush with the exposed face of the associated lid wall.

3. The improvement of claim 2 wherein each one of the telescopically connected tubes has a series of circumferential ridges and interspersed grooves thereon; said tubes being oriented so that the ridges on one of the tubes nest within the grooves of the other tube; said tubes being formed of a semi-resilient plastic material that allows the ridges to slightly deform under pressure, whereby one tube can be telescoped into the other tube until the tube flanges are clamped against the exposed faces of the lid walls.

4. The improvement of claim 3 wherein said lock bolt comprises an axial shaft having a key-engageable plate having an edge area thereof slidably riding on said guide means; said guide means including a guide plate engageable with said shaft at a point remote from said key-engagable plate; said spring means comprising a coil spring trained around said shaft between said guide plate and said key-engageable plate.

* * * * *